US005590433A

United States Patent [19]

Fricke

[11] Patent Number: 5,590,433

[45] Date of Patent: Jan. 7, 1997

[54] MONOLITHIC CAST BRIDGE

[76] Inventor: Obed M. Fricke, 306 S. Aztec, Montezuma, Kans. 67867

[21] Appl. No.: 528,551

[22] Filed: Sep. 15, 1995

[51] Int. Cl.[6] ..... E01D 4/00; E01D 18/00

[52] U.S. Cl. ..... 14/24; 52/87; 52/88

[58] Field of Search ..... 14/2.4, 24, 25, 14/69.5, 73, 77.1, 6, 9, 10, 11, 74.5; 405/124, 149; 52/86, 87, 88, 81.6, 80.2; 404/15, 16

[56] References Cited

U.S. PATENT DOCUMENTS

| | | | |
|---|---|---|---|
| 230,933 | 8/1880 | Fryer, Jr. | 14/9 X |
| 309,063 | 12/1884 | Kellogg | 14/9 X |
| 459,301 | 9/1891 | Murphy | 14/10 |
| 542,531 | 7/1895 | Ogle | 14/9 |
| 743,946 | 11/1903 | Spaulding | 52/87 |
| 2,370,763 | 3/1945 | Whitney | 52/88 |
| 2,984,944 | 5/1961 | Sapp | 14/9 |
| 3,768,108 | 10/1973 | Wadsworth | 14/24 |
| 4,563,107 | 1/1986 | Peterson | 405/124 |
| 5,199,819 | 4/1993 | Matiere | 52/88 X |

*Primary Examiner*—James A. Lisehora
*Attorney, Agent, or Firm*—Hovey, Williams, Timmons & Collins

[57] ABSTRACT

A monolithic cast bridge broadly includes a unitary, monolithic structure (12) having a pair of spaced haunches (14, 16) a span (18) having upper and lower surfaces (20, 22) and a pair of axially extending webs (24, 26). Haunches (14, 16) define support-engaging undersides (28, 30) which are provided for supporting the bridge above a support level (48). The lower surface (22) of the span (18) extends upwardly from each of the haunches (14, 16) to present a maximum rise relative to the haunch undersides (28, 30) at a midpoint (50) of the span (18). The webs (24, 26) are spaced and substantially parallel with respect to each other, and respectively include lower surfaces (52, 58). The lower surfaces (52, 58) are substantially flat and correspond to the haunch undersides (28, 30). A pair of reinforcement cables (64, 66) are advantageously positioned within respective webs (24, 26), and are configured for reinforcing the structure (12) along its longitudinal axis.

2 Claims, 1 Drawing Sheet

5.
5.

MONOLITHIC CAST BRIDGE

BACKGROUND OF THE INVENTION

1. Field of the Invention

The present invention relates to the construction of prefabricated cast arched structures. More particularly, the monolithic cast bridge hereof concerns a unitary structure including an arched span, and an axially extending load bearing web depending from the span.

2. Description of the Prior Art

Presently, in the construction of cast arched structures, such as bridges, it is known to provide an arched span which extends between and is supported at its ends by a pair of opposed support elements. Such a span also commonly includes a plurality of integral transverse webs depending from the span.

In fabricating such a structure, a form is assembled at the construction site. Cast material, such as concrete, is poured into the form. Once the cast material is set, the form is dismantled, and the structure is coupled with the support elements, if necessary, and then is ready for use.

The transverse webs depending from the arched span, however, do not support loads along the longitudinal axis of the structure. Therefore, reinforcement of such arched structures generally entails inserting sheets of rebar, or similar sheet-like reinforcing members, into the span before the cast material is poured. The combination of rebar and cast materials yield a structure having sufficient strength along its longitudinal axis so that it may serve as a bridge.

Since rebar is relatively flat and sheet-like, it must be bent in order to conform to the shape of the arched span. As a result, rebar is relatively difficult and labor intensive to properly position within an arched form. This problem is amplified as the thickness of the arched span decreases.

As cast materials are poured into forms, small air pockets develop. These pockets are virtually impossible to detect. Since these air pockets affect the integrity of the structure, they must be reduced or eliminated by compacting the material.

One known method of compacting the material and eliminating air pockets involves the use of stirring devices. Such devices are commonly hand-held, and include an elongated shaft with a stirring tip. The tip is inserted into the material for agitation before the material has cured. In order to fully agitate the material, the stirring tip must come into close contact with the entire volume of the structure. As a result, using such devices is relatively time consuming, and labor intensive.

There is accordingly a real and unsatisfied need in the art for an improved arched structure which eliminates the need for positioning rebar within the structure as a means for reinforcement, and which may be prefabricated, transported to the construction site, and set in place as a unitary body. There is also a need to provide a structure which may be constructed and compacted without using stirring devices as a means of reducing air pockets and other defects within the structure.

SUMMARY OF THE INVENTION

The present invention addresses the problems discussed above, and provides a significant advance in the art. More particularly, the monolithic structure hereof includes a load bearing axial web depending from an arched span, eliminating the need for positioning rebar within the structure.

The structure may be fabricated, and transported to the construction site as a unitary body for placement.

A prefabricated cast bridge broadly includes a unitary, monolithic structure having a pair of spaced haunches, a span, and a web depending from the span. The span extends between the haunches and presents opposed upper and lower surfaces. The web depends from the span lower surface and extends generally axially therealong between the haunches. The web provides support along the longitudinal axis of the structure.

Each of the haunches defines a support-engaging underside. These undersides are configured for resting on a pair of support surfaces, and thus for supporting the structure on the support surfaces. The lower surface of the span extends upwardly from each of the haunches to present a maximum rise relative to the haunch undersides at a general midpoint of the span.

A prestressed cable is positioned within the web as a reinforcement means for increasing the load bearing capacity of the structure. The cable is held in tension by opposed anchoring devices, such as end plates, attached at the ends of the cable. Use of such a cable eliminates the need for placement of rebar within the span. As prestressed cables are much easier to position relative to rebar, using such a cable significantly lowers the labor, and thus expense, of reinforcing bridges.

Various other reinforcing elements may be used which are also relatively inexpensive. For example, a threaded bar may be inserted through the web, and fixed within the web by anchoring devices, such as end plates. Post tensioned cable may be used as well.

In a preferred configuration, the structure includes a pair of parallel, axially extending webs depending from the span. Such a double "T" configuration allows the structure to be wide enough and strong enough to be used as a bridge, such as a golf cart bridge at a golf course. In an alternative configuration, the structure includes only one web. Such a single "T" configuration allows the structure to serve as a bridge for agricultural devices such as a center pivot sprinkler tower, and as a walkway bridge.

As a result of its unitary construction, the structure may be fabricated away from the construction site, transported to the site, and placed for use. The integral haunches are configured for supporting the structure at its ends, and for simplifying the placement of the structure.

In another application, the structure is used as a roof element for a building having concrete walls. When used as a roof element, the single "T" configuration of the haunches are placed atop opposed walls of the building so that the structure spans across the opposed walls. The haunches extend beyond the outer portion of the walls to define soffits. The structures are spaced apart, such as about 12'–15', and purlins are placed between the structures. The structures and purlins cooperably define an aesthetically pleasing arched roof. Alternatively, the structures are placed side by side. The double "T" configuration of the structure may also be used as a roof element.

DESCRIPTION OF THE DRAWING FIGURES

DETAILED DESCRIPTION OF THE PREFERRED EMBODIMENT

Figures 1, 2, 3, 4, 5:
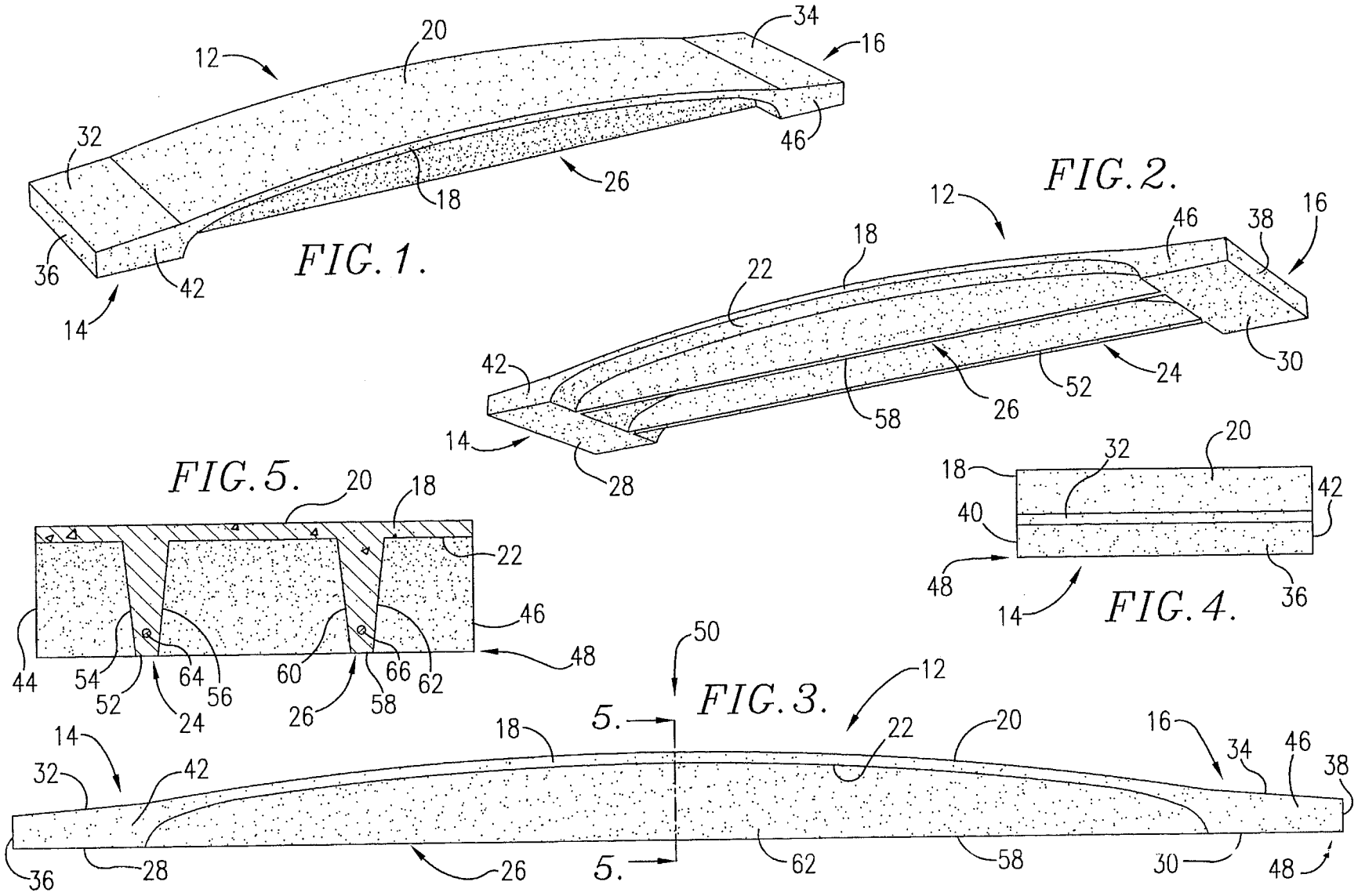
FIG. 1 is a perspective view of a preferred monolithic cast bridge of the present invention illustrating the upper surface of the span.
FIG. 2 is a perspective view of the bridge of FIG. 1 illustrating the lower surfaces of the span and webs.
FIG. 3 is a side elevational view of the bridge of FIG. 1.
FIG. 4 is an end elevational view of the bridge of FIG. 1.
FIG. 5 is a cross-sectional view of the bridge taken along line 5—5 of FIG. 3.

Referring now to FIGS. 1 and 2, a monolithic cast bridge constructed in accordance with the invention is illustrated. In broad terms, the bridge includes structure 12 having spaced haunches 14, 16 and span 18. Span 18 extends between haunches 14, 16, and includes upper and lower surfaces 20, 22. Webs 24, 26 depend from span lower surface 22.

Haunches 14, 16 define support-engaging haunch undersides 28, 30, upper surfaces 32, 34, and end faces 36, 38. In addition, haunch 14 includes opposed side walls 40, 42, and haunch 16 includes opposed sidewalls 44, 46. Upper surface 32 is sloped so that surface 32 and underside 28 converge toward end face 36. Upper surface 34 is sloped so that surface 34 and underside 30 converge toward end face 38.

Haunches 14, 16 are flat and define a support level, shown at numeral 48. Haunches 14, 16 are thus configured for supporting structure 12 on a pair of opposed support surfaces (not shown). Haunches 14, 16 thus support structure 12 above the support level, at 48.

Span lower surface 22 extends upwardly from each of the haunches 14, 16 to present a maximum rise relative to haunch undersides 28, 30 at midpoint 50 of span 18. In the illustrated preferred embodiment, each of span upper and lower surfaces 20, 22 defines a profile which substantially corresponds to an arc segment a circle.

Webs 24, 26 are substantially parallel with respect to each other, and extend axially along structure 12 between haunches 14, 16. Web 24 includes lower surface 52 and a pair of opposed, converging faces 54, 56. Web 26 includes lower surface 58, and a pair of opposed converging faces 60, 62. Lower surfaces 52, 58 are substantially flat and correspond with haunch undersides 28, 30, and thus the support level, at 48. Lower surfaces 52, 58 also substantially correspond to a secant line of the arc segment defined by the profile of span lower surface 22.

Prestressed cables 64, 66 are positioned within respective webs 24, 26 as a reinforcement means for increasing the load bearing capacity of structure 12. Cables 64, 66 are anchored at their respective ends by end plates (not shown). The end plates, which are positioned within structure 12, hold cables 64, 66 in tension. The end plates may alternatively be mounted outside structure 12, such as adjacent to end faces 36, 38.

In a preferred form, structure 12 is used as a bridge, and is constructed of cast material, such as concrete. It will be appreciated that structure 12 constructed of concrete has sufficient load bearing capacity to function as a bridge. Cables 64, 66 further increase the load bearing capacity of structure 12.

Structure 12 is fabricated using a two piece form (not shown) having a top portion removably coupled with a bottom portion. When the top and bottom portions are coupled, the form includes walls which define substantially the same interior dimensions and shape as the exterior of structure 12. The form walls also define an upper opening through which the cast material is poured.

When fabricating structure 12, cables 64, 66 are first positioned within the bottom portion. The top portion is then coupled with the bottom portion. Next, the cast material is poured in two layers.

In the first layer, the material is poured into the form until the material reaches the intersection of midpoint 50 and span lower surface 22. Thus the first layer includes all of load bearing webs 24, 26. Once the first layer is poured, the material is agitated by vibrating devices (not shown) strategically mounted along the form. The vibrating devices act to compact the material and reduce the quantity and size of air pockets therein.

Next, the second layer is poured. This layer includes the remaining volume of structure 12. It will be appreciated that the second layer does not include any of webs 24, 26, and thus does not support as great a load as the first layer. As a result, compaction of the second layer is not necessary. Therefore, less cast material is required, reducing the costs associated with constructing structure 12.

Additionally, the relatively gentle arc of span 18 allows the form to be used without a top hinged cover for the opening. Such covers are difficult and time consuming to position. Therefore, by eliminating the need for the top hinged cover, the labor associated with fabricating arched structure 12 is reduced.

Once the cast material has cured, the top portion is de-coupled from the bottom portion, and structure 12 is removed. Hydraulic jacks (not shown) are provided at the bottom of the form for assisting in the removal of structure 12 from the form by separating the surfaces of structure from the form walls. Attachment devices (not shown), such as internally tapped sleeves, eyelets, or other devices, are positioned along span upper surface 20. A lifting device, such as a crane, is connected with the attachment devices so that once the jacks have separated structure 12 from the form walls, the crane is able to lift structure 12 out of the form.

It will be appreciated that structure 12, fabricated in the above mentioned manner, advantageously may be fabricated away from the construction site, and later transported to the site as a unitary body. Structure 12 may be transported by any known means of transportation, such as by trailer, rail, etc. When transported by trailer, structure 12 is lifted from the trailer and placed on the support surfaces.

Structure 12 is configured for placement in a spanning relationship with a gully, ditch, or other topographic feature generally characterized by an elongated depression and opposed banks. Structure 12 thus serves as a bridge over the depression. The support surfaces are configured for engaging undersides 28, 30, and are formed on each of the banks. For example, a poured concrete pad is fabricated on each of the banks to provide a support surface. The pad may be made of other cast material as well. Of course, it is also possible to level the banks and cover the support surfaces with gravel, or simply level the banks and compact the support surfaces. After the support surfaces have been prepared, structure 12 is placed on them.

In a preferred use, structure 12 is a golf cart bridge. It will be appreciated that structure 12 offers an aesthetically pleasing arched appearance which serves to enhance the attractive setting of a golf course. The combination of arched span 18 and sloped haunches upper surfaces 32, 34 allows structure 12 to readily shed water during inclement weather.

Of course, structure 12 may serve a variety of other purposes as well, such as being a walkway bridge, or an agricultural bridge for center pivot sprinkler towers. Such towers include an elongated sprinkler line which is positioned within a field, and is configured to rotate about the center pivot for irrigation of the field. However, many fields include ditches and other depressions having steep banks which prevent passage of the sprinkler line. Structure 12 is then positioned in a spanning relationship with such a ditch, allowing the sprinkler line to pass over the ditch.

Although the monolithic cast bridge has been described in accordance with the illustrated preferred embodiment, it is noted that variations and changes may be made, and alternatives employed herein without departing from the scope of the invention as set forth in the claims. It will also be understood that the use of the term "bridge" herein is meant to include all structures for bridging the gap between or spanning two support surfaces, such as bridges, trestles, walkways, roof elements, etc.

Span upper and lower surfaces 20, 22 are illustrated which define profiles that substantially correspond to an arc segment a circle. Surfaces 20, 22 may alternatively define various other profiles, which correspond to segments of polygonal shapes, and segments of other geometric shapes, such as a parabola, hyperbola, ellipse, etc.

Prestressed cables 64, 66 have been shown, however, other reinforcement means for increasing the load bearing capacity of structure 12 may be used. As an example, threaded bar is positioned within webs 24, 26. Each bar is coupled at their respective ends with end plates. The end plates are configured to retain the bar in a tensioned state. After the bar has been positioned, the cast material is poured into the form. Post tensioned cable may, of course, also be used as a means of increasing the load bearing capacity of structure 12.

In an alternative configuration, a single "T" configuration of structure 12 includes a single web depending from span 18, and extending axially therealong between haunches 14, 16. The single "T" configuration, which is narrower than the illustrated double "T" configuration having webs 24, 26, reduces the relative material requirements, and thus the cost, of fabrication. The single "T" configuration may be used as a walkway bridge, and also as a sprinkler tower bridge.

Structure 12 may also be used as a roof element for a building having concrete walls. In such a use, a plurality of structures 12 are positioned atop opposed walls. Haunches 14, 16 extend beyond the walls to define soffits. Structures 12 are positioned approximately 12–15' apart. Purlins are then placed on top of structures 12 to present an aesthetically pleasing arched roof. It will be appreciated that the combination of purlins and structures 12 may be easily sealed for weatherproofing. Structures 12 may alternatively be placed side-by-side and sealed for weatherproofing. Either the single "T" or double "T" configuration may be used as a roof element.

What is claimed is:

1. A bridge consisting essentially of a unitary, monolithic, cast concrete body having:

a pair of spaced haunches, each of said haunches presenting an underside for engaging a support for said bridge;

an arcuate span, said span presenting opposed upper and lower arcuate surfaces and a pair of opposed side surfaces, said span extending upwardly between said pair of haunches to present a highpoint relative to said haunches, said highpoint being on said span upper surface, said highpoint being generally midway between said haunches; and at least one web for increasing the load-bearing capability of said span, said web extending downwardly from said span lower surface and axially along said span lower surface for the entire distance between said haunches, said web presenting opposed side surfaces and a bottom surface, said web side surfaces converging towards each other between said lower surface of said span and the web bottom surface, the height of said web being less than one-half the width of said span, said bridge being configured for use as a golfcart bridge, a walkway bridge, or an agricultural bridge for center pivot sprinkler towers.

2. The bridge of claim 1, including a pair of generally parallel, spaced-apart webs, the shortest distance between adjacent opposed side surfaces of said webs being greater than said web height, the shortest distance between a web side surface and an adjacent span side surface being greater than one-half of said web height.

* * * * *